United States Patent [19]

Massie

[11] Patent Number: 4,505,448

[45] Date of Patent: Mar. 19, 1985

[54] BRACKET FOR FIRE EXTINGUISHERS

[76] Inventor: Claude P. Massie, 122 B Log Trail, Ballwin, Mo. 63011

[21] Appl. No.: 524,857

[22] Filed: Aug. 19, 1983

[51] Int. Cl.[3] ..... A62C 39/00

[52] U.S. Cl. ..... 248/313; 24/270

[58] Field of Search ..... 248/313, 311.2, 231, 248/216.1, 218.3, 316.1; 211/71; 24/285, 483, 270, 271, 272, 273, 19; 285/311

[56] References Cited

U.S. PATENT DOCUMENTS

| | | | |
|---|---|---|---|
| 1,083,159 | 12/1913 | Tibbals | 248/313 |
| 1,235,865 | 8/1917 | Whiteker | 24/19 |
| 1,256,355 | 2/1918 | Mundt | 248/231 |
| 1,288,839 | 12/1918 | Conrad | 248/313 |
| 1,480,085 | 1/1924 | Linard | 248/313 |
| 1,727,213 | 9/1929 | McMullen . | |
| 1,735,932 | 11/1929 | Nelson | 24/271 |
| 3,021,584 | 2/1962 | Polanski | 24/270 |
| 3,194,529 | 7/1965 | Brock | 248/313 |
| 3,224,720 | 12/1965 | Hain | 248/313 |
| 3,797,077 | 3/1974 | Omori | 24/273 |
| 4,213,592 | 7/1980 | Lingenfelser | 248/313 |
| 4,304,383 | 12/1981 | Huston | 248/313 |

FOREIGN PATENT DOCUMENTS

| | | | |
|---|---|---|---|
| 214297 | 8/1960 | Austria | 248/313 |

*Primary Examiner*—William H. Schultz
*Assistant Examiner*—Robert A. Olson
*Attorney, Agent, or Firm*—Haverstock, Garrett & Roberts

[57] ABSTRACT

A compact bracket particularly suited for mounting fire extinguishers on aircraft, trucks, boats, railroad cars and the like comprised of a base member adapted to engage a fire extinguisher including strap members pivotally connected to the base member and adapted to extend about the fire extinguisher engaged by the latching member. The free ends of the strap members include a latch mechanism such that the strap members may be releasably latched about the extinguisher. At least one of the strap members has a protuberance extending from the extinguisher engaging surface thereof near the free end thereof. Such protuberance holds the adjacent portion of such strap member away from the extinguisher. The protuberance establishes a fulcrum whereby the strap members snap into a latched position below the fulcrum and the strap members spring apart as they are brought into a position above the fulcrum with the snap and spring action being enhanced due to the protuberance holding the portion of the strap member adjacent thereto away from the extinguisher. As a result, external forces commonly encountered in moving vehicles and the like increase rather than decrease the grip of the latching member on the extinguisher when the strap members are latched together. Preferably, the bracket may also include a lower base member for engaging and supporting the bottom of an extinguisher while the latching member simultaneously engages the extinguisher. The upper base member and the lower base member may be connected to form a unitary structure.

3 Claims, 6 Drawing Figures

BRACKET FOR FIRE EXTINGUISHERS

BACKGROUND OF THE INVENTION

I. Field of the Invention

The present invention is a compact bracket on which fire extinguishers may be securely mounted. The bracket is particularly suited for attachment inside aircraft, trucks, tanks, boats, railroad cars and the like where mounting space is at a premium and the bracket with extinguisher mounted thereon is often subjected to external forces such as are commonly encountered in moving vehicles.

II. Description of the Prior Art

Fire extinguisher brackets typically have been constructed for attacnment to an interior wall with the extinguisher being mounted in a vertical position. Problems arise when such brackets are attacned in areas of limited space such as the interior of a vehicle, aircraft or the like and subjected to forces such as are commonly encountered during normal travel and especially during a crash. For example, the brackets disclosed in Hain U.S. Pat. No. 3,224,720 and Reynolds U.S. Pat. No. 4,119,288 contain no mechanism that positively latches about the extinguisher such that the extinguisher is more strongly gripped by the bracket as the magnitude of the external forces increases. Also, problems often arise in trying to quickly release an extinguisher from a bracket. One such problem in Brock U.S. Pat. No. 3,194,529 wherein one must follow the relatively time-consuming process of unlatching the latch mechanism and then pulling the portions of the latch mechanism out of the way as much as possible before the extinguisher can be removed. This problem is magnified when the latch mechanism is fixed in one position as is the case with the Hain and Brock devices. Brackets have typically included a mechanism for preventing discharge of the extinguisher until it is removed from the bracket as is shown in the Hain and Brock patents. The inclusion of such mechanism in a bracket attached to the interior of a vehicle, aircraft or the like, where removal of the extinguisher from the bracket is blocked, often renders the extinguisher inoperable at a time when it is most likely to be needed.

SUMMARY OF THE INVENTION

The present invention overcomes the problems associated with use of prior mounting brackets by including a latching member adapted to engage a fire extinguisher where the latching member includes strap members connected thereto which are adapted to extend about the fire extinguisher. The strap members include complementary portions of a latch mechanism connected thereto for latching the strap members about the extinguisher. A protuberance extends from one of the free strap members near the end to engage the surface of a fire extinguisher mounted on such bracket such that the protuberance holds the adjacent portion of the strap member away from the extinguisher. The complementary portions of the latch mechanism and the protuberance are positioned such that the protuberance establishes a fulcrum with the complementary portions of the latch mechanism snapping together in a latched position at a point below the fulcrum. When so latched, the strap members exert a torque on the extinguisher thereby pressing the extinguisher into the latching member with the torque increasing as external forces of increasing magnitude are experienced. Thus, the bracket can securely hold the extinguisher even in the presence of sizable external forces. As the complementary portions of the latch mechanism are pulled apart, they reach a point above the fulcrum where further release is automatic and the portions spring apart. The strap members are adapted to be pivotally connected to the base member so that the force of the complementary portions of the latch mechanism springing apart causes the attached strap members to also spring apart. Because the protuberance holds the portion of the strap member adjacent thereto out of mating engagement with the fire extinguisher, the snap and spring action of the latch mechanism is enhanced. Such a quick-release mechanism is quite important when an extinguisher is mounted in a vehicle, aircraft and the like where, due to limited space. Every second counts in fighting a fire. The strap members are constructed to be detachable from the pivot means so that the strap members can be reversed to alter the orientation of the associated complementary portions of the latch mechanism, thus permitting ready access to the latch mechanism regardless of the position in which the bracket is attached. The position of the extinguisher may be vertical, horizontal, inverted, or some angle in between. In addition, the present invention is constructed to allow the extinguisher to be used without removing it from the bracket, a feature that becomes critically important should it become impossible to remove the extinguisher from the bracket.

It is a principal object of the present invention to provide a bracket suitable for use where limited space is available both for mounting a fire extinguisher bracket and for removing an extinguisher from such bracket and where the bracket with extinguisher mounted thereon is subjected to sizable external forces.

It is also an object of the present invention to provide a bracket adapted to securely mount a fire extinguisher in any position, including vertical, horizontal, inverted, or any angle therebetween.

Another object is to provide a fire extinguisher bracket featuring a latch mechanism that allows quick removal of the extinguisher from such bracket.

It is also an object to provide a bracket having reversible straps with a latch mechanism adapted to be reversed to permit the latch mechanism to be accessible regardless of the position of the bracket.

Still another object is to provide a fire extinguisher bracket which permits the extinguisher to be used even when the extinguisher remains mounted on the bracket.

Yet another object is to provide a fire extinguisher bracket having interchangeable strap members pivotally connected thereto, the strap members adapted to extend about a fire extinguisher of any dimension and adapted to be engaged by latching members with the free ends of the strap members having complementary portions of a latch mechanism connected thereto. A still further object is to provide a fire extinguisher bracket with complementary straps having complementary parts of a latch mechanism wherein a protuberance extends from the inner side of one strap member near the end.

Another object is to provide complementary portions of the latch mechanism which are adapted to positively latch together at a position below a fulcrum established by the protuberance whereby the strap members exert a torque pressing the extinguisher into engagement with the latching member and the complementary latch portions automatically spring apart after being moved from a latched position to a position above the fulcrum.

BRIEF DESCRIPTION OF THE DRAWINGS

These and other objects and advantages of the present invention will become apparent after considering the following detailed specification in conjunction with the accompanying drawings wherein.

DESCRIPTION OF THE PREFERRED EMBODIMENT

Figure 1:
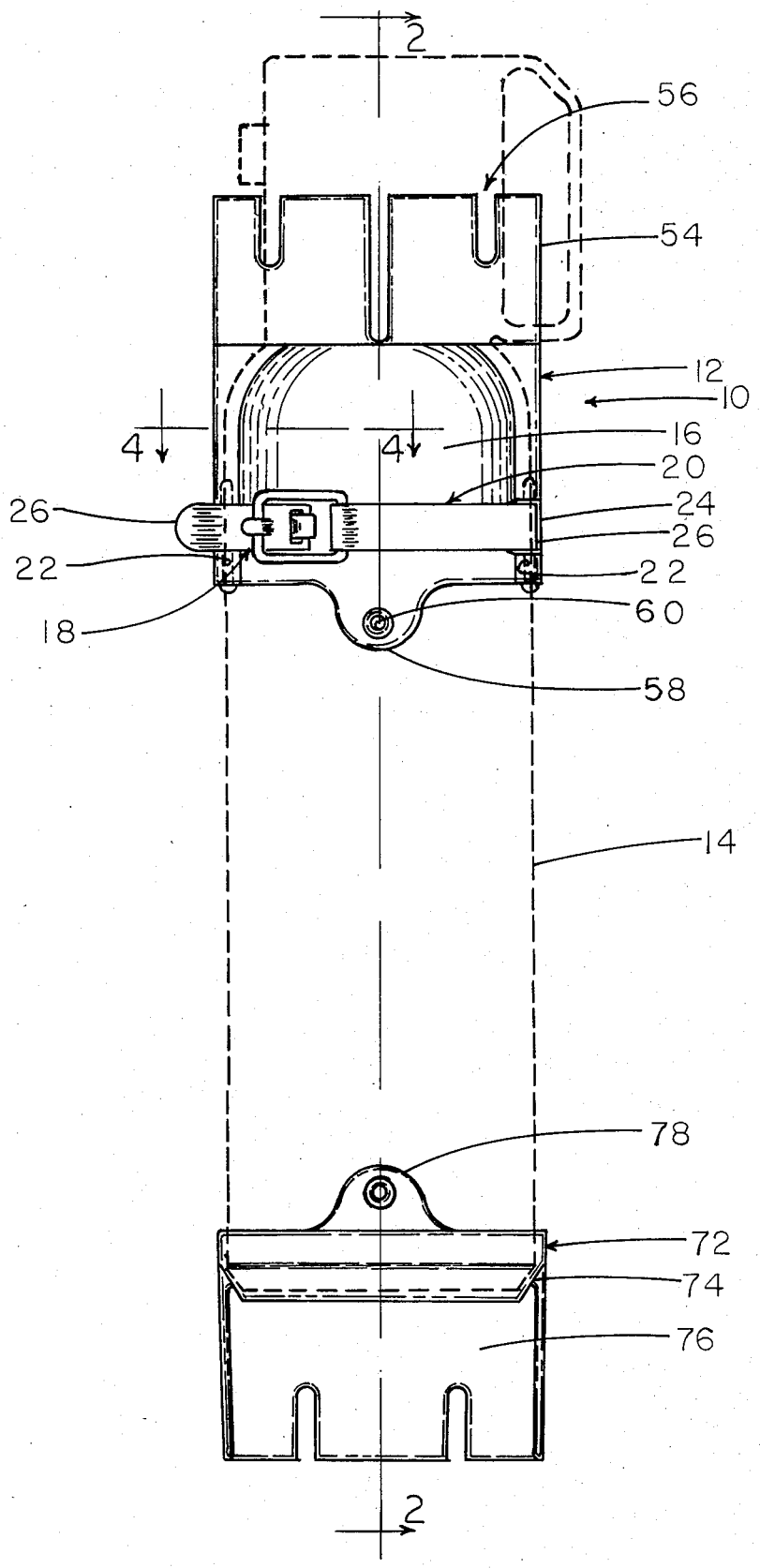
FIG. 1 is a front elevational view of a bracket with a fire extinguisher mounted thereon, the extinguisher being shown in phantom.

Referring to FIG. 1, a preferred embodiment of the present invention is shown including a bracket 10 comprised of a base member 12 on which a fire extinguisher 14 may be mounted. The base member 12 includes a portion such as face 16 adapted to engage a portion of the fire extinguisher. Base member 12 also includes strap members 18 and 20 pivotally connected thereto and extending outwardly therefrom, the strap members being adapted to extend about the extinguisher and latch thereabout to exert a torque sufficient to force the extinguisher into tignt-fitting engagement with the latching member.

Figure 2:
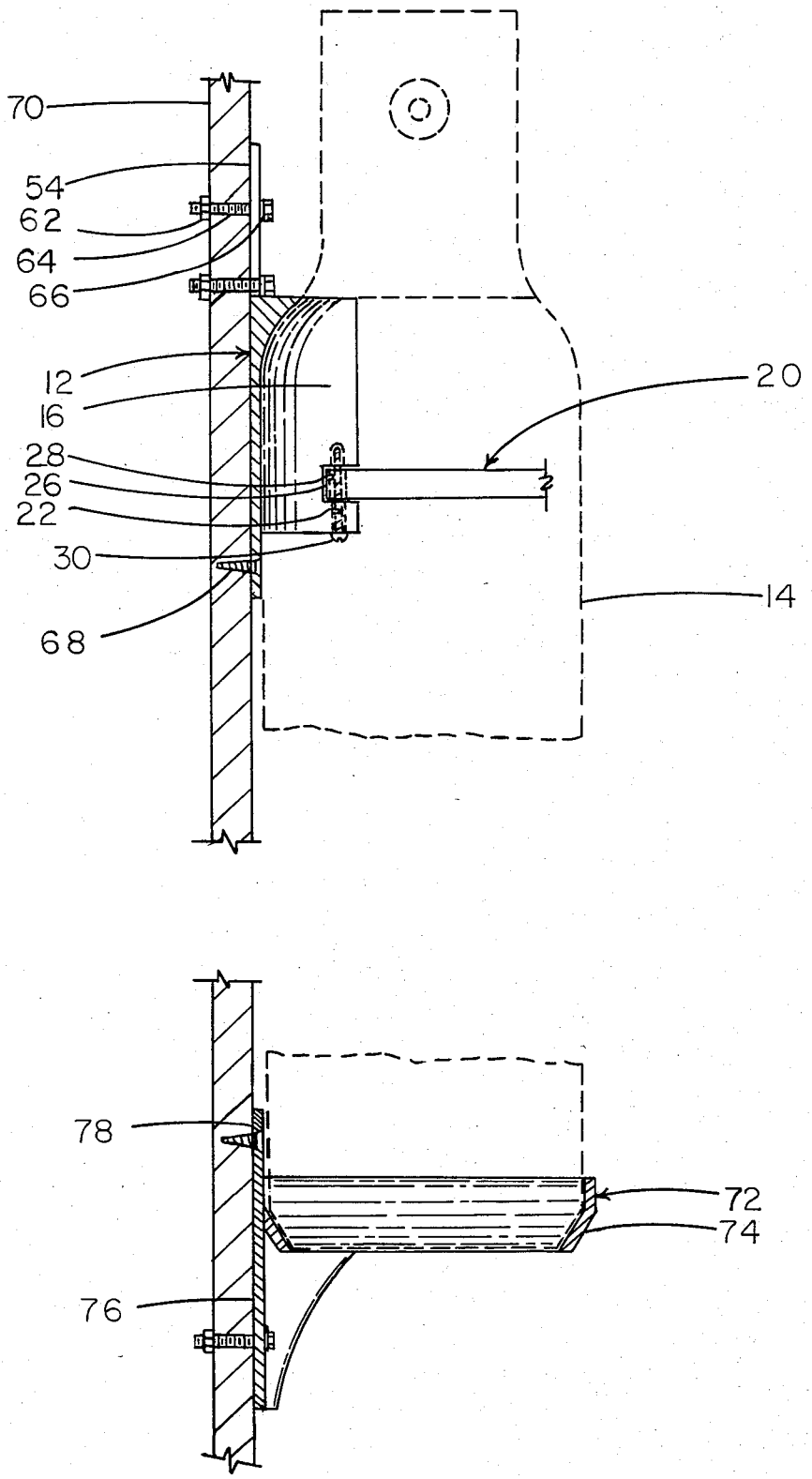
FIG. 2 is a cross-sectional view of the bracket shown in FIG. 1 taken along line 2—2 of FIG. 1.

The means for pivotally connecting the strap members to the latching member include pivot pin openings 22 extending into the base member 12 adjacent the face 16 thereof in a direction parallel to the longitudinal axis of the bracket. Opposed portions of the base member 12, are notched and removed to save weight without sacrificing strength. Cut-outs 24 are adapted for receiving strap ends 26 of the strap members 18 and 20. The size of the cut-outs may be varied to accommodate straps of varying lengths and width. As shown in FIG. 2 each strap end 26 has an opening 28 therethrough adapted to register with, and be of slightly greater bore than, corresponding pivot pin opening 22. Each strap member is similarly connected to the latching member by means of a pivot pin 30, dimensioned to extend through the remaining portions of each opening 22, and registered strap end opening 28, and be attached to the latching member. As a result, each such pivot pin serves to securely connect a strap member to the latching member while also providing a pivot axis for pivoting of each strap member thereabout. Consequently, the strap members can be pivoted away from the extinguisher so as not to necessitate additional lateral clearance in order to remove the extinguisher from the bracket.

It is preferred that the pivot means be constructed so that it can be disassembled, as for example by using screws as pivot pins as shown in FIG. 2 or, as another alternative, through the use of bolts as pivot pins where the bolts extend through the latching member and lock washers and nuts are used to secure the bolts to the latching member. By being able to disassemble the pivot means, the strap members may be easily removed and reversed so that the latch mechanism attached to the strap members may be made more accessible. This is especially desirable where, as shown in FIG. 1, the strap members are of unequal length so that the latch mechanism is positioned closer to one side of the latching member than the other. In addition, such a construction would permit strap members of varying lengths and widths to be interchanged so that the bracket may be used with extinguishers of various dimensions.

Figure 3:
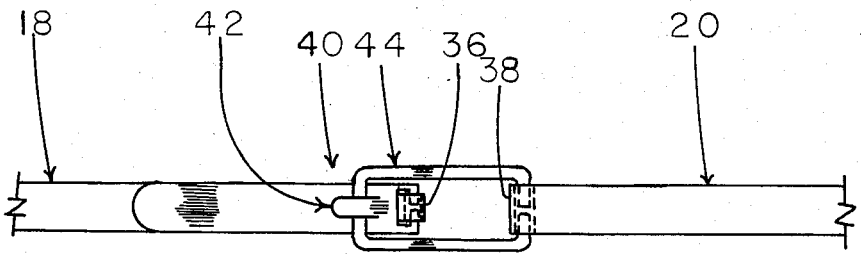
FIG. 3 is an enlarged fragmentary front elevational view of the latch mechanism of the bracket shown in FIG. 1.

The strap members 18 and 20 as shown in FIG. 3, preferably are comprised of flexible spring metal. Each flexible strap member preferably has a degree of curvature corresponding generally to the extinguisher mounted thereon so that as the latch mechanism is closed the strap members will be pulled into tight-fitting engagement with the extinguisher. Besides including previously described ends 26 adapted to connect the latching members, the strap members 18 and 20 also include end portions 36 and 38 respectively which include complementary portions of the latch mechanism 40 which can include hook portion 42 and clasp portion 44. Hook portion 42 and clasp portion 44 are attached to and part of strap members 36 and 38 so that latching of the complementary latch portions may be easily effected.

Figure 4:
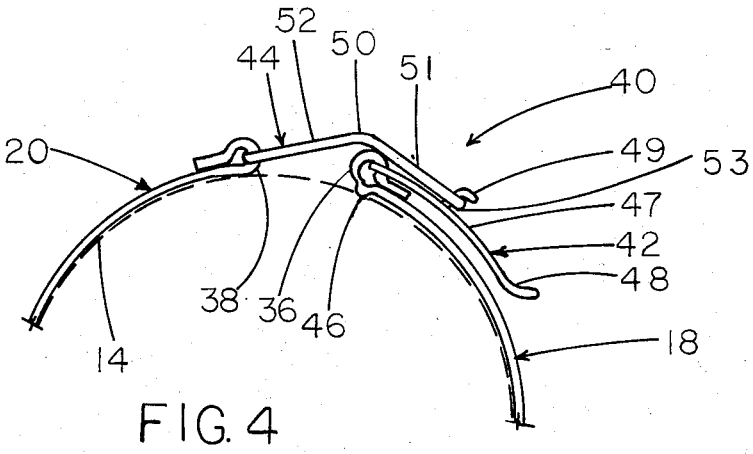
FIG. 4 is an enlarged fragmentary cross-sectional view of the latch mechanism of the bracket shown in FIG. 1 taken generally along line 4—4 of FIG. 1 with the latch mechanism being shown in a closed position.
Figure 5:
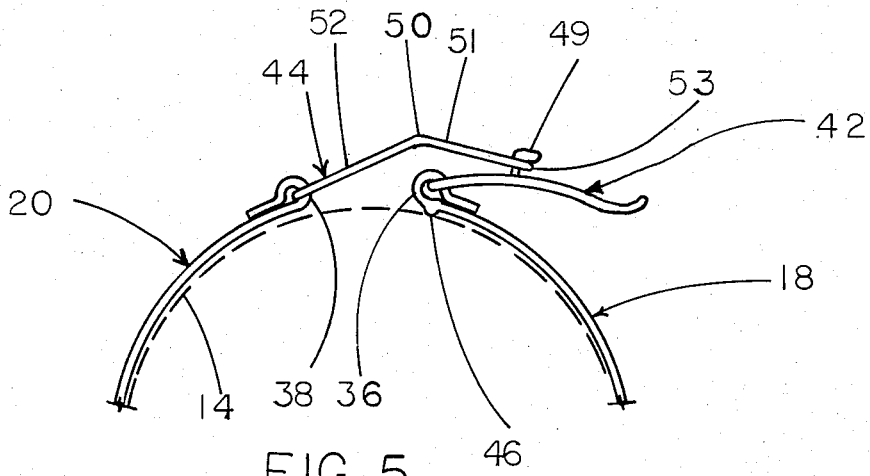
FIG. 5 is an enlarged fragmentary cross-sectional view of the latch mechanism of the bracket shown in FIG. 1 taken generally along line 4—4 of FIG. 1 with the latch mechanism being shown in a partially opened position; and, FIG. 6 is a front elevational view of an alternative embodiment of a bracket with a fire extinguisher mounted thereon, the extinguisher being shown in phantom.

In the preferred embodiment, strap member 18 also includes a protuberance 46, as shown in FIGS. 4 and 5, extending from the inner surface of strap member 18 and engageable with the extinguisher. The protuberance 46 causes the adjacent portion of strap member 18 to be moved out of tight-fitting engagement with the extinguisher 14 and establishes a fulcrum, features critical to the operation of the latch mechanism 40. The protuberance 46 is preferably shaped like a bump although it can be of any configuration such as a pillar, box shape or the like. The size of the protuberance can be varied to accommodate the size of the extinguisher. It has been found that a semi-spherical bump having a radius between 0.02 and 0.25 inches will provide the necessary spacing for most extinguishers. A bump between 0.05 and 0.08 inches in radius is preferred when the present invention is used with a Model 6000 fire extinguisher containing 6.5 pounds of a Halon 1301 and 1211 mixture, such fire extinguisher being manufactured by ASP International, Inc. and being particularly well suited for extinguishing fires in vehicles, aircraft, and the like.

In the preferred embodiment, the hook portion 42 of the latch mechanism 40 includes an elongated section 47 which is shown in FIG. 4 having a curvature generally corresponding to that of the extinguisher, but which could be also of a different configuration, e.g. without having any curvature at all. The hook portion 42 also includes an end section 48 extending angularly from the elongated section 47 as shown in FIGS. 4 and 5 for providing a section that may be grasped to lock and unlock the latch. A hook 49 extends from the surface of elongated section 47 of the hook portion 42, facing away from the extinguisher when the extinguisher is mounted thereon and is adapted for engagement with clasp portion 44.

The clasp portion 44 in the preferred embodiment is generally V-shaped when viewed from the top as shown in FIGS. 4 and 5 with the base 50 located at the juncture of V leg sections 51 and 52 of the clasp portion corresponding generally to the location of the protuberance 46 and preferably offset from being directly over protuberance 46 so as to be somewhat closer to strap member end 38. The clasp portion side 53 is adapted to engage the hook 49 of hook portion 42.

When latching the strap members together, the protuberance 46 located adjacent strap member end 36 holds the adjacent portion of strap member 18 out of tight-fitting engagement with the extinguisher 14 and also establishes a fulcrum with the size, shape, angle, and location of the hook 49 of hook portion 42 and the V base 50 of clasp portion 44. The length of V legs 51 and 52 of clasp portion 44, and the size, shape, and location of the protuberance 46 are such that there is a point below such fulcrum as best shown in FIG. 4 where the hook and clasp portions snap together in a latched position with the holding of the portion of strap member 18 adjacent protuberance 46 away from the extinguisher enhancing this snap action latching effect. When so latched, the hook and clasp portions exert a relatively large amount of torque to press the extinguisher into engagement with the base member such that external forces on the bracket plus extinguisher serve to increase rather tnan decrease the grip of the bracket on the extinguisher by further increasing the torque exerted by the strap members. As the hook and clasp portions are unlatched, they pass beyond this point and spring apart with an equally great amount of relative force because, as best shown in FIG. 5, they are in contact above the fulcrum established by the protuberance and the holding of the strap member adjacent the protuberance away from the extinguisher by the protuberance similarly enhances this spring action. Thus, a quick-release mechanism is provided for unlatching the strap members.

The protuberance should be constructed to be sufficiently dominant to hold the portion of the strap member adjacent thereto out of engagement with a mounted extinguisher so as to enhance as much as possible both the snap and spring action of the latch mechanism while at the same time not interfering with the fulcrum effect or making it difficult to operate the latch mechanism. The amount of torque that can be applied by the latched strap members and the corresponding amount of force involved when the strap members spring apart as they are unlatched can be varied as desired by altering the size, shape, angle, and location of the hook 49 and the clasp portion V base 50, the length of the clasp V legs 51 and 52, and the size, shape, and location of the protuberance 46. Furthermore, such alterations also enable the torgue and corresponding snap and spring action forces to be maintained at a constant figure when construction of the entire bracket is altered to accommodate extinguishers of various shapes and sizes.

The preferred embodiment of the base member also includes mounting means for attaching the base member 12 to a support surface. Such means include a plate 54, that is perhaps best shown in FIG. 1, extending from adjacent one end of the base member 12 with spaced mounting slots 56 therethrough as well as a flange 58 extending from adjacent the opposite end of the base member 12 with a mounting hole 60 located through such flange. As shown in FIG. 2, means such as nuts 62, bolts 64, and lock washers 66, screws 68 and the like can then be used to draw the base member 12 into tight-fitting engagement with the support surface 70.

Typically, extinguishers have a tapered neck, cylindrical body and rounded bottom. Therefore, in the preferred embodiment of the present invention, the face 16 of the base member 12 has a compound contoured surface conforming to the shape of the tapered neck and cylindrical body of the extinguisher 14 mounted thereon as shown in FIGS. 1 and 2. Such a configuration permits the base member to engage an extinguisher over a relatively broad area and increases the ability of the latching member to securely hold the extinguisher when external forces are acting against the sides and/or bottom of the extinguisher. However, a construction to engage both the neck and body of the extinguisher is not always required and in such instances a member adapted to engage either the neck or the body of the extinguisher may prove sufficient. Where engagement of both the neck and body of the extinguisher by the base member is desired, other embodiments of the present invention can be employed including elimination of the compound curved nature of the face and substitution of a member projecting from the base member and adapted to separately engage the neck of the extinguisher while the body of the extinguisher is otherwise engaged by the latching member. Furthermore, should the extinguisher be of other than a cylindrical shape, the construction of the latching member may be altered such that the latching member includes a portion engageable with the extinguisher and the strap members constructed to be connected to the latching member adjacent such portion of the latching member and adapted to extend about the extinguisher and latch together so as to press the extinguisher into tight-fitting engagement with such portion.

The preferred embodiment also includes constructing the face of the base member to extend less than half way about the extinguisher at any location. The reason for this is to minimize the amount of lateral clearance required to remove the extinguisher from the bracket. Typically, only about one-half inch of lateral clearance is required to remove the extinguisher from the preferred embodiment of the present invention. This is especially desirable when the bracket is attached in aircraft, trucks and the like where there is little room to attach the bracket and many objects such as seats and so forth could end up in quite close proximity to the bracket should a crash occur. When the availability of lateral clearance is not a problem, such a construction is not required.

The present invention also may include a lower base member 72 as shown in FIGS. 1 and 2 for use in supporting the bottom of an extinguisher 14 while the upper body and/or neck of the fire extinguisher is simultaneously engaged by the base member 12. In it preferred form the lower base member 72 is comprised of a tapered walled portion 74 with an open end, the walled portion 74 being adapted to enclose the lower body and bottom of the extinguisher. It is preferred that walled portion 74 be sleeve-like in construction in order to minimize the weight of the bracket. It is also preferred that at least some part of the walled portion be tapered because if the lower base member is not mounted in perfect alignment with the upper base member, whether because of human error or space limitations, as long as the bottom of the extinguisher is generally disposed within said walled portion, then there is adequate contact to securely hold the extinguisher. In addition, the introduction of external forces will serve to improve the seating of the extinguisher therein and likewise strengthen the grip of the present device on the extinguisher. The lower base member 72 also includes mounting means for attaching the lower base member to a support surface 70 as shown in FIG. 2. The mounting means are preferably of a construction similar to that employed with the upper base member including a slotted plate 76 and a flange 78 with a hole therethrough extending in opposite directions from the lower base member 72. Attachment means, such as bolts, lock washers and nuts, screws, and the like, may be used to draw the lower base member 72 against the support surface 70. The lower base member 72 may be constructed in other forms including a plate extending under the bottom of the extinguisher, a ring-shaped member adapted to engage a ring of greater diameter projecting outwardly from the side of the extinguisher, and so forth depending on the shape of the extinguisher involved.

While it is preferred that the upper base member and lower base member be attached as a unit when the bracket is mounted where it is likely to encounter external forces and it is generally preferred that botn members be attached as a unit when otherwise mounting the bracket, it is within the scope of this invention that the upper base member may be used alone to hold the extinguisher. However, it is preferred for most uses that both the upper base member and the lower base members be used together to provide maximum adaptability and strength.

Employment of the preferred form of the bracket for supporting a fire extinguisher as shown in FIGS. 1 and 2 is particularly desirable when the bracket is to be mounted in an aircraft. Federal regulations require that supporting structure aboard aircraft be designed to withstand forces equal to at least two times the force of gravity (2 g) acting in an upward direction, 9 g in a forward direction, 1.5 g in a sideward direction, and 4.5 g in a downward direction. (14 C.F.R. 25.561(c) A bracket made in accordance with this invention has been shown to safely retain an extinguisher mounted thereon even when subjected to forces exceeding 9 g in any direction. Thus, a bracket so constructed may be used aboard aircraft and mounted as space permits at any angle required, including vertical, horizontal, inverted, or any angle in between.

The present invention is preferably cast of aircraft grade aluminum in order to minimize the weight of the bracket without sacrificing strength. Other materials such as iron, steel, plastic products such as fiber glass reinforced resins and polycarbonates could be used. The entire bracket or parts thereof may be coated with a thin layer of an elastomeric material in order to protect the surface of an extinguisher held thereby.

The strap members of this invention may be constructed in varying lengths and interchangeable to accommodate any fire extinguisher. Also, the straps may be extendible by any means well known in the art such as by making them in two parts with multiple matching holes and held together with small bolts or snap-in mating projections.

Figure 6:
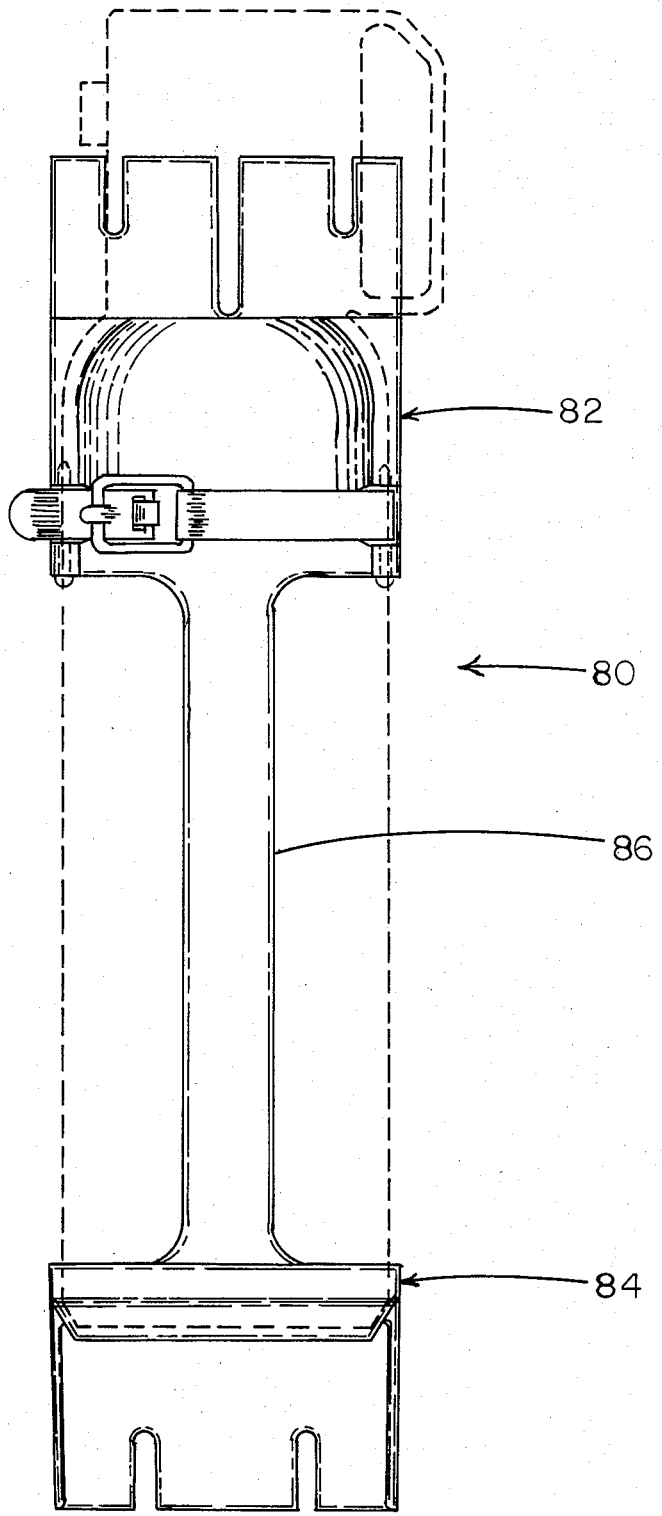

An alternative embodiment of the present invention is shown in FIG. 6 wherein the bracket 80 is constructed as a one-piece unit including a base member 82 and a lower base member 84 with means such as a strip 86 provided for connecting lower base member 84 and upper base member 82. The construction of the present device as a one-piece unit generally adds a small amount of added weight to the device. While a one-piece construction ensures perfect alignment of the upper base member and the lower base member, this is not usually necessary and in some instances, space requirements may make it impossible to so mount the bracket.

While the present invention appears to show its greatest utility as a bracket for fire extinguishers attached in aircraft, vehicles and the like where the extinguisher is generally of a cylindrical shape with a tapered neck and rounded bottom, the present invention also can be adapted for other forms and purposes such as fire extinguishers of other configurations or structures with other utilities such as oxygen cylinders for use in ambulances and hospitals, tanks of various gases and/or liquids such as are used in the chemical industry, water softener tanks, poison treatment kits and the like. Use of the present invention is called for whenever there is a need for a bracket that is able to securely hold the device mounted thereon even while experiencing external forces, quickly release the device when desired, and/or release the device where a minimal amount of lateral clearance is available.

Thus, there has been shown and described several embodiments of a novel bracket for fire extinguishers, which embodiments fill all of the objects and advantages sought therefor. It will be apparent to tnose skilled in the art, however, that many changes, modifications, variations, and other uses and applications for the subject device are possible. All such changes, modifications, variations, and other uses and applications which do not depart from the spirit and scope of the invention are deemed to be covered by the invention which is limited only by the claims which follow.

What is claimed is:

1. A bracket for fire extinguishers comprising a base member including a face adapted to engage a fire extinguisher, mounting means associated therewith for mounting said base member to a support surface, and strap members connected thereto adjacent said face and extending outwardly therefrom adapted to fit about a fire extinguisher engaged by said face, said strap members having free ends with complementary latch portions connected thereto adapted for releasably latching said strap members about a fire extinguisher engaged by said face, said strap members being movable between a closed position wherein said latch mechanism is adapted to latch said straps to engage a fire extinguisher and press it into tight-fitting engagement with said face and an open position wherein a fire extinguisher can be moved laterally from said bracket without encountering said mounting means, one of said strap members having a fire extinguisher engaging surface with a substantially semi-spherical protuberance extending inward from a position near the free end thereof, said protuberance adapted to hold an adjacent portion of said fire extinguisher-engaging surface of said strap member out of abutting alignment with a fire extinguisher and establishing a fulcrum such that said complementary latch portions snap into a latched position below said fulcrum and automatically spring apart once said latch portions are brought to a position above said fulcrum.

2. A bracket adapted for mounting a removable device comprising a fastening member adapted to engage a device including mounting means associated therewith for mounting said fastening member to a support surface and strap members pivotally connected thereto and extending outwardly therefrom adapted to fit about a removable device engaged thereby such that said strap members may be pivoted about pivot axes parallel to the longitudinal axis of the bracket adapted to allow lateral removal of a device from the bracket without encountering said fastening member, said strap members having complementary fasteners connected thereto for detachably fastening said strap members about the device such that a torque is exerted pressing a device into tight-fitting engagement with said fastening member, at least one of said strap members having a substantially semi-spherical protuberance extending inwardly from a position thereof near where such strap member connects to the respective complementary fastener, said protuberance holding an adjacent portion of such strap member out of engagement with a removable device and establishing a fulcrum such that said complementary fasteners snap into a fastened position below the fulcrum and spring apart as said complementary fasteners are brought from a fastened position to a position above the fulcrum.

3. The bracket of claim 2 wherein said protuberance is semi-spherical in shape with a radius between 0.02 and 0.25 inches.

* * * * *